United States Patent [19]

Kantor

[11] Patent Number: 4,957,246

[45] Date of Patent: Sep. 18, 1990

[54] TOILET ROLL COVER

[76] Inventor: Karen D. Kantor, 64 Peppler St., Unit 32, Waterloo, Ontario, Canada, N2J 4P7

[21] Appl. No.: 493,762

[22] Filed: Mar. 15, 1990

[51] Int. Cl.[5] ..... B65D 85/67

[52] U.S. Cl. ..... 242/55.53; 206/390; 206/823; 206/205

[58] Field of Search ..... 242/55.53; 206/389, 206/390, 398, 400, 823, 205

[56] References Cited

U.S. PATENT DOCUMENTS

| | | | |
|---|---|---|---|
| 2,579,201 | 12/1951 | Pendergast | 242/55.53 |
| 4,513,862 | 4/1985 | Mallow | 206/823 |
| 4,721,264 | 1/1988 | Muscarello | 242/55.53 |
| 4,739,943 | 4/1988 | Geller | 242/55.2 |

*Primary Examiner*—William I. Price

*Attorney, Agent, or Firm*—Carson, Armstrong

[57] ABSTRACT

A toilet roll cover suitable for covering both wall mounted and free standing toilet rolls is disclosed. The invention provides embellishment of the interior design of a bathroom and may enhance hygiene and air quality. The invention comprises a piece of material, preferably lined with stiff interfacing, formed into a generally cylindrical shape with a longitudinal opening running substantially from end to end. The generally cylindrically shaped piece is formed by placing the piece around a new roll of toilet paper and pulling radially inwardly the piece's lateral ends across most of the area of the ends and securing the ends by fastening means such as a ribbon threaded through a sewn channel. The preferred embodiment is further characterized by a band of lace or the like running longitudinally adjacent one side of the longitudinal opening, forming a pouch which can accommodate fragrance exuding means such as pot pourri.

4 Claims, 3 Drawing Sheets

TOILET ROLL COVER

BACKGROUND OF THE INVENTION

This invention relates to devices for covering toilet paper rolls.

Toilet roll covers in the prior art generally do not permit functional use of the toilet roll when they are used on wall mounted toilet rolls. In addition, existing toilet roll covers are limited in their ability to be coordinated with a wide variety of interior designs.

There is a need for an effective and attractive toilet roll cover which can be installed on the toilet roll and still permit use.

SUMMARY OF THE INVENTION

Certain design characteristics of the invention produce an improved toilet roll cover. Desirable attributes of the invention include features such as embellishment of the interior design of the room, and provision of protection of the toilet roll from excessive room air humidity, thereby enhancing the sanitary conditions local to the toilet area by avoiding the creation of a moist microenvironment conducive to proliferation of endogenous household fungi and other microorganisms within the toilet paper roll. The invention also provides a means for enhancing unobtrusively the quality of the room air by adding a fragrant odour to the room air in the close vicinity of a toilet.

In accordance with the present invention there is provided a toilet roll cover that covers a roll of toilet paper, either freestanding or when it is mounted onto a wall or the like.

The invention comprises a piece of fabric, plastic or like material(s) formed into a generally cylindrical shape with a longitudinal opening running substantially from end to end, through which longitudinal opening sheets of toilet paper may be pulled by the user.

The cylindrical shape of the piece is formed by placing the piece around a new roll of toilet paper or the like so that the longitudinal opening running substantially from end to end of the piece lies at the leading edge of the toilet paper roll and generally perpendicular to the direction in which sheets of toilet paper may normally be unrolled from the toilet paper roll. Using this roll of toilet paper as a shaping form, the generally cylindrical shape of the piece is fixed by pulling the piece radially inwardly at the lateral ends of the generally cylindrical shape, across most of the area of the ends, by pulling and fastening means. The inner face of the generally cylindrically shaped piece may be lined with one or more inserts or stiff interfacing to preserve the generally cylindrical shape. The front face of the generally cylindrical piece may have one or more bands of lace or the like secured by one or more fastening means such as a hook and pile closure, and the front band a may accommodate fragrance exuding means (such as pot pourri).

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
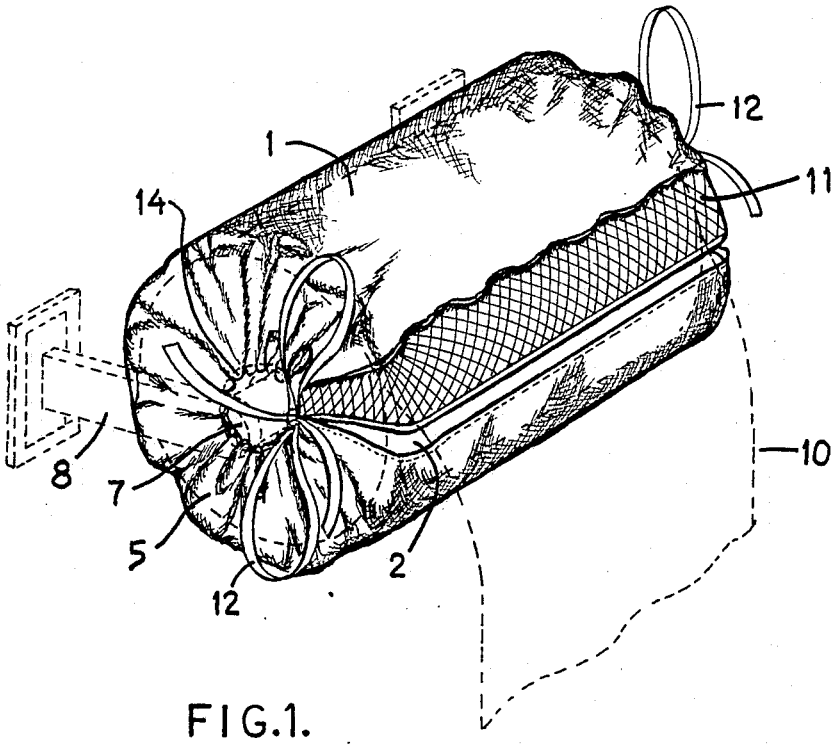
FIG. 1 is a perspective view of the preferred embodiment, as the embodiment would appear installed on a wall mounted toilet roll.
Figure 2:
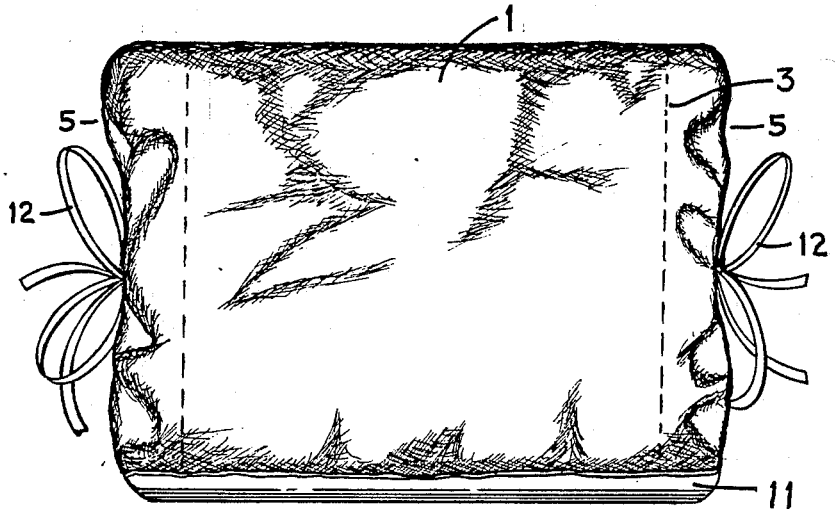
FIG. 2 is a corresponding top view.
Figure 3:
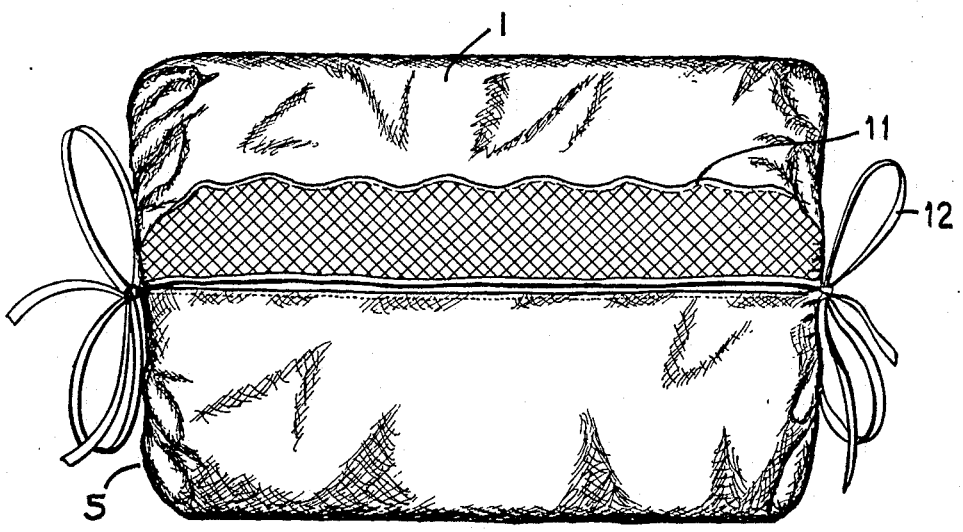
FIG. 3 is a corresponding front view.
Figure 4:
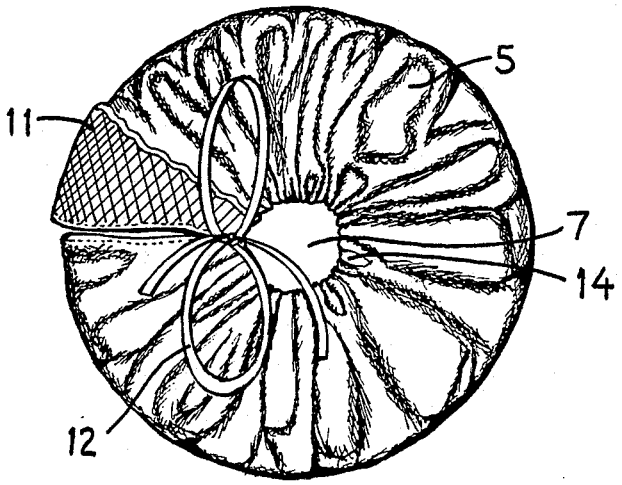
FIG. 4 is a corresponding end view.

Referring to FIG. 1, the preferred embodiment comprises a piece of fabric 1 (such as satin, silk, nylon, or other textile), plastic, or the like, preferably with interfacing 3 (see FIG. 2) secured to the inner face of the piece to make the overall structure slightly stiffer, to hold the overall shape. Piece 1 is formed into a generally cylindrical shape with a longitudinal opening 2 running substantially from end to end. The material of the piece 1 is pulled radially inwardly at opposite ends thereof to form end faces 5. In both of the end faces 5, inner circular gaps 7 of diameter sufficient to accommodate a wall mounted lateral toilet paper roll suspension means 8 in such a way that a toilet paper roll may rotate freely through 360 degrees about the wall mounted lateral toilet suspension means 8 when the invention is in use, to permit toilet paper 10 to be drawn.

The interfacing 3 serves as a stiffener to maintain the generally cylindrical shape of piece 1 as the diameter of roll of paper left on the toilet paper roll decreases with removal of toilet paper. Choice of the nature of the material used for forming the interfacing (with particular reference to such characteristics as stiffness, thickness, impermeability) may vary with the nature of the material used to form piece 1. The preferred embodiment is characterized by a satin piece 1 with an interfacing of an iron-on material such that the interfacing material may be secured to the satin piece by means of heat transfer.

When the preferred embodiment is used with a wall or the like mounted toilet roll, the longitudinal opening 2 enables a leading sheet of the toilet paper 10 to feed and roll freely at an approximately perpendicular angle through the longitudinal opening 2 in the piece 1.

The preferred embodiment of the invention is further characterized by ribbons or like means fastened into bows 12 at either end of the generally cylindrically shaped piece 1. The bows 12 are formed by tying lengths of ribbon which are threaded through a sewn channel 14 at the furthermost lateral ends of the generally cylindrically shaped piece 1. The ribbons are used to pull the material of the piece inwardly to form the end faces 5, and are then tied to form the bows 12 to secure the end faces in that position.

The preferred embodiment of the invention is further characterized by a band 11 of lace or the like running longitudinally adjacent to one side of the longitudinal opening 2. Although the band may have a decorative purpose, and thus may be colour or appearance coordinated with a towel set, for example, it preferably serves the further purpose of cooperating with the piece 1 to form a pouch which accommodates fragrance exuding means such as pot pourri. The lower and side edges of the band are sewn or otherwise sealed to the piece 1, and the upper edge of the band is open but preferably securable against the piece 1 by any suitable fastening means, such as hook and pile fastening means (e.g. VELCRO TM), for example, to close the pouch. It is an advantage of the preferred embodiment that the fragrance exuding means is situated unobtrusively in close proximity to the toilet (not shown).

It will be appreciated that the above description relates to the preferred embodiment by way of example only. Many obvious variations could be envisioned, and such variations are considered to be within the scope of the invention as described and claimed, whether or not expressly described.

Figure 5:
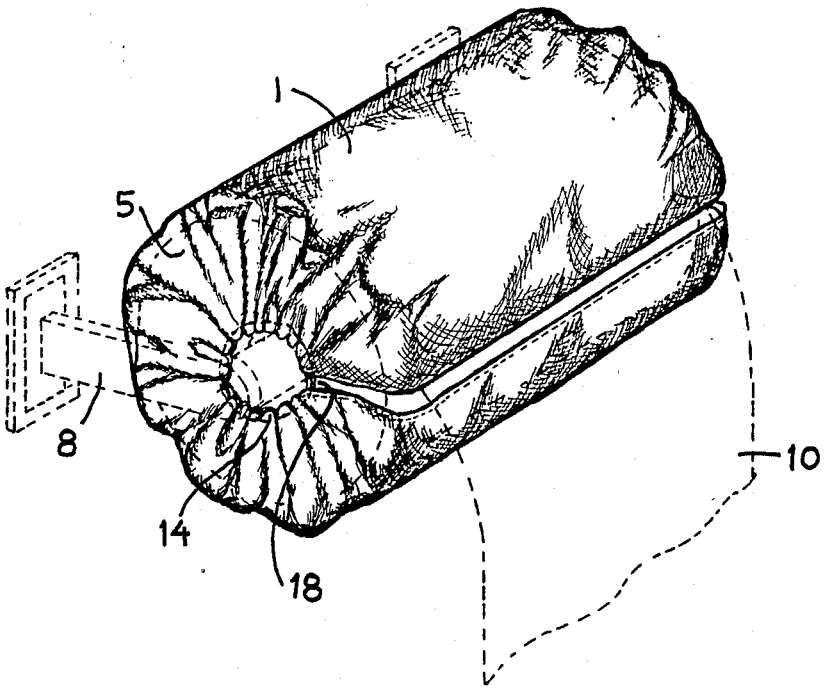
FIG. 5 is a perspective view of an alternative embodiment.

For example, one such anticipated variant is depicted in FIG. 5. In this version, neither the bows nor the fragrance exuding means are included. The principle of the cover is identical to the embodiment shown in FIG. 1, however. In this variant, lengths of elastic material 18 are fastened circularly into the innermost edges of the flaps 14 of faces 5 to act in place of the ribbon means and bows 12.

A second such anticipated variant comprises a securing means for securing one or more pieces of interfacing to the piece 1, whereby the interfacing is inserted into and held by the outer piece 1 via recesses formed by seams, slits and tabs or other means. For example, a plastic liner may be used, the opposite longitudinal ends of the liner being set into fitted seams formed along the inner faces of the edges of piece 1 which abut the longitudinal opening 2 running substantially from end to end of piece 1. The pouches formed by the fitted seams secure the liner substantially adjacent the inner face of piece 1, whereby the liner assumes the generally cylindrical shape of piece 1. The intrinsic stiffness of the plastic liner is sufficient to maintain the generally cylindrical shape of piece 1 in the absence of there being any substantial support provided by contact of piece 1 and the toilet paper roll.

It will also be appreciated that the pouch for pot pourri or the like, if one is provided, need not be formed by the band 11 of lace or the like, but could be formed by a separate piece of material sewn or otherwise fastened to the outer surface of the generally cylindrically shaped piece 1 at any convenient location, i.e. by a pocket which is not otherwise an integral part of the cover.

What is claimed as the invention is:

1. A cover for a roll of toilet paper on a toilet paper suspension means, comprising a piece of material formed into a generally cylindrical shape with a longitudinal opening running substantially from one end of said generally cylindrical shape, and drawing and fastening means for pulling the material of said generally cylindrical piece radially inwardly at said ends to form end faces each having an inner circular gap left in both of said end pieces to accommodate said toilet paper suspension means.

2. A toilet roll cover as claimed in claim 1, further comprising an insert of interfacing adjacent the inner face of said generally cylindrically shaped piece.

3. A toilet roll cover as claimed in claim 1, further comprising a band of material running longitudinally adjacent one side of said longitudinal opening, said band cooperating with said piece of material to define a pouch therebetween, said pouch being adapted to receive fragrance exuding means.

4. A toilet roll cover as claimed in claim 2, further comprising a band of material running longitudinally adjacent one side of said longitudinal opening, said band cooperating with said piece of material to define a pouch therebetween, said pouch being adapted to receive fragrance exuding means.

* * * * *